United States Patent [19]

Reuschel et al.

[11] Patent Number: 5,058,964

[45] Date of Patent: Oct. 22, 1991

[54] STORAGE CABINET-WORKSURFACE ARRANGEMENT

[75] Inventors: Jeffrey Reuschel, Hamilton; Charles R. Newell, Grand Haven; Alan R. Wright, Wyoming, all of Mich.

[73] Assignee: Haworth, Inc., Holland, Mich.

[21] Appl. No.: 534,290

[22] Filed: Jun. 7, 1990

[51] Int. Cl.[5] ..... A47B 88/00

[52] U.S. Cl. ..... 312/111

[58] Field of Search ..... 312/194, 195, 111, 203, 312/237; 206/821; 211/194

[56] References Cited

U.S. PATENT DOCUMENTS

| | | | |
|---|---|---|---|
| 1,303,985 | 5/1919 | Straubel | 312/102 X |
| 3,125,385 | 3/1964 | Friedman | 312/107 |
| 3,207,097 | 9/1965 | Schreyer | 312/194 X |
| 3,606,506 | 9/1971 | Ungaro | 312/111 |
| 3,842,991 | 10/1974 | Koebel | 206/821 X |
| 4,138,015 | 2/1979 | Rabley | 206/821 X |
| 4,787,553 | 11/1988 | Hoskins | 206/821 X |
| 4,846,435 | 7/1989 | Cohen | 206/821 X |

*Primary Examiner*—Joseph Falk

*Attorney, Agent, or Firm*—Flynn, Thiel, Boutell & Tanis

[57] ABSTRACT

A storage cabinet arrangement which involves independent upper and lower cabinets of compatible design and cross section. The lower cabinet can be provided with access through one of the side walls thereof, such as by providing drawers which open through the front or narrow side of the cabinet. The upper cabinet can be provided with an access opening through the side or depth dimension of the cabinet so as to be accessible from and open directly over an adjacent worktop. The upper cabinet can be horiozntally rotated 180° relative to the lower cabinet so as to open either rightwardly or leftwardly relative to the lower cabinet. The upper and lower cabinets stack together through intermediate reveal strips which are removably mounted on the top edges of the lower cabinet. One of the reveal strips can be removed and a worktop support bracket positioned in its place, which bracket projects sidewardly beyond the cabinet and has structure for securing one end of a worktop.

10 Claims, 2 Drawing Sheets

STORAGE CABINET-WORKSURFACE ARRANGEMENT

FIELD OF THE INVENTION

This invention relates to an improved storage cabinet arrangement, such as for use in offices and the like, and in particular to an improved storage cabinet arrangement which can be used for supporting one end of a worktop.

BACKGROUND OF THE INVENTION

In the office environment, systems-type furniture is extensively utilized. Such systems furniture involves series of connected upright space divider panels, and furniture components such as worktops, drawer units and the like mounted thereon. Freestanding components such as files and tables are also used in conjunction with such systems.

One of the common problems encountered in offices, whether using systems furniture or freestanding furniture, is the difficulty in maximizing the amount of storage for papers, books and the like through use of storage cabinets commonly refer to as drawer or file units, and at the same time provide optimum and efficient utilization of floor space. In particular, orienting of storage cabinets such as drawer and file units has continued to present a problem to office designers since orienting of the storage cabinets so as to provide optimum accessibility and convenience of use often conflicts with desired and optimum spacial arrangement of other furniture components. Particularly when dealing with systems furniture, wall panels are used to define workstations of predetermined area, and maximizing both the amount and accessibility of storage cabinets, without interfering with and in fact optimizing the use of adjacent worktops, has been a longstanding problem. In systems-type workstations, it is conventional to provide a small drawer unit directly under or adjacent one end of a worktop, and in many instances the drawer unit may project upwardly above the worktop so as to provide increase storage capacity. In such units, however, the drawers or storage space is generally accessible only from one side, namely the front side, and this is particularly inconvenient in situations where the depth of the cabinet exceeds its width and hence makes efficient utilization of the storage space difficult. Further, with these known arrangements, it is normally necessary to support the end of the worktop, as disposed adjacent the cabinet, either by means of its own supporting end panel or leg structure, or by attaching a support bracket to the adjacent side face of the cabinet, which in turn effects defacing of the cabinet.

It is an object of this invention to provide an improved office-type storage cabinet arrangement, which cabinet overcomes or at least greatly improves upon many of the disadvantages set forth above.

More specifically, the present invention relates to an improved storage cabinet arrangement which involves independent upper and lower cabinets of compatible design and cross section, which cabinets vertically stack on top of one another, and the lower cabinet preferably has a height which substantially corresponds to worktop height. The lower cabinet can be provided with access through one of the side walls thereof, such as by providing drawers which open through the front or narrow side of the cabinet. In contrast, the upper cabinet can be provided with an access opening through the side or depth dimension of the cabinet so as to be accessible from and open directly over an adjacent worktop, thereby increasing accessibility and optimizing storage capability of both the upper and lower cabinets. Further, the upper and lower cabinet can be readily horizontally rotated 180° relative to one another so that the upper cabinet can open either rightwardly or leftwardly relative to the lower cabinet.

In a preferred embodiment of the cabinet arrangement according to the present invention, the upper and lower cabinets preferably stack together through intermediate reveal strips which are removably mounted on the top of the lower cabinet and extend along the edges thereof. These removable reveal strips facilitate the stacking of the upper and lower cabinets by improving appearance since unsightly appearance characteristics created by dimensional variations or tolerances is eliminated. Further, when it is desired to position and in fact support an adjacent end of a worktop on the cabinet, one of the reveal strips can be removed and a worktop support bracket positioned in its place, which bracket projects sidewardly beyond the cabinet and has structure suitable for securing one end of a worktop. This bracket can be positioned in the place of the reveal strip, and anchored to the top of the lower cabinet if necessary, following which the upper cabinet can again be repositioned over the lower cabinet. The end of the worktop can be supported directly on the cabinet without requiring defacing of the exterior side of the cabinet. Further, the worktop can be attached to any side of the lower cabinet merely by removing the appropriate reveal strip.

Other objects and purposes of the invention will be apparent to persons familiar with structures of this general type upon reading the following specification and inspecting the accompanying drawings.

Figure 1:
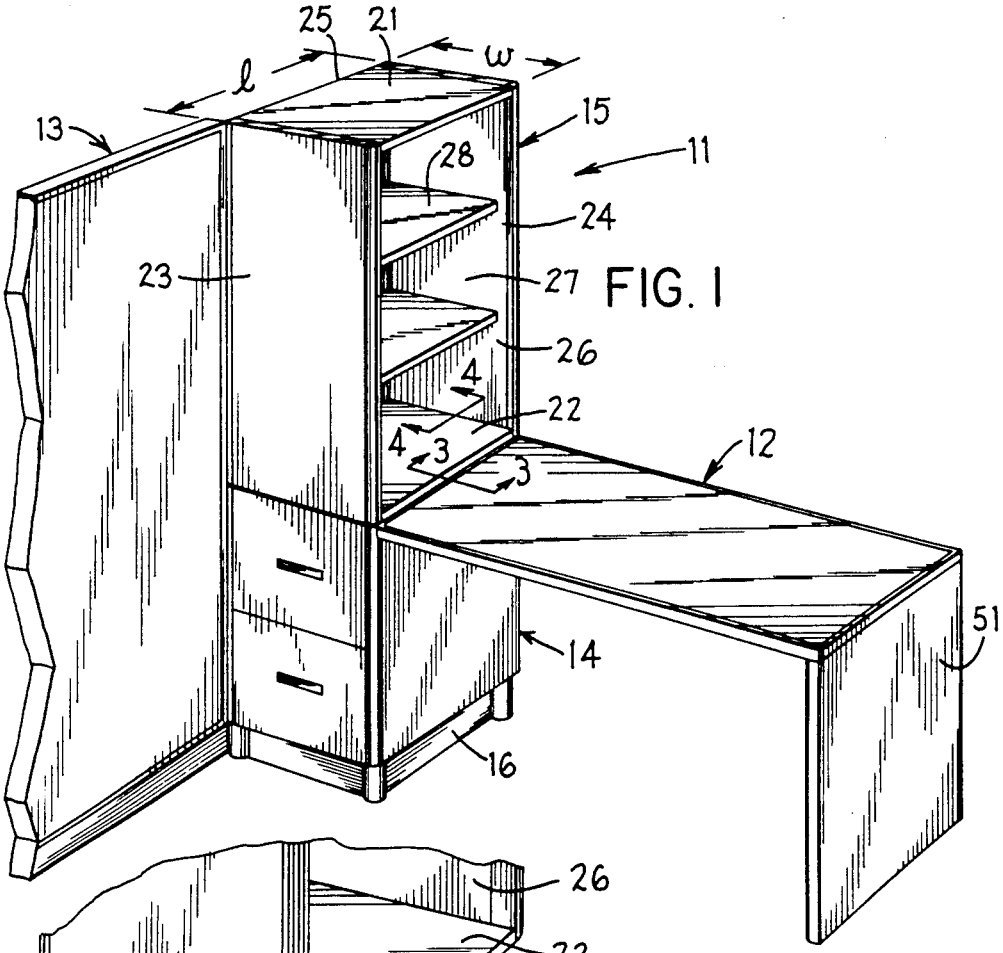
FIG. 1 is a perspective view illustrating a cabinet of the present invention, and its association with respect to an adjacent worktop and space divider panel.
Figure 2:
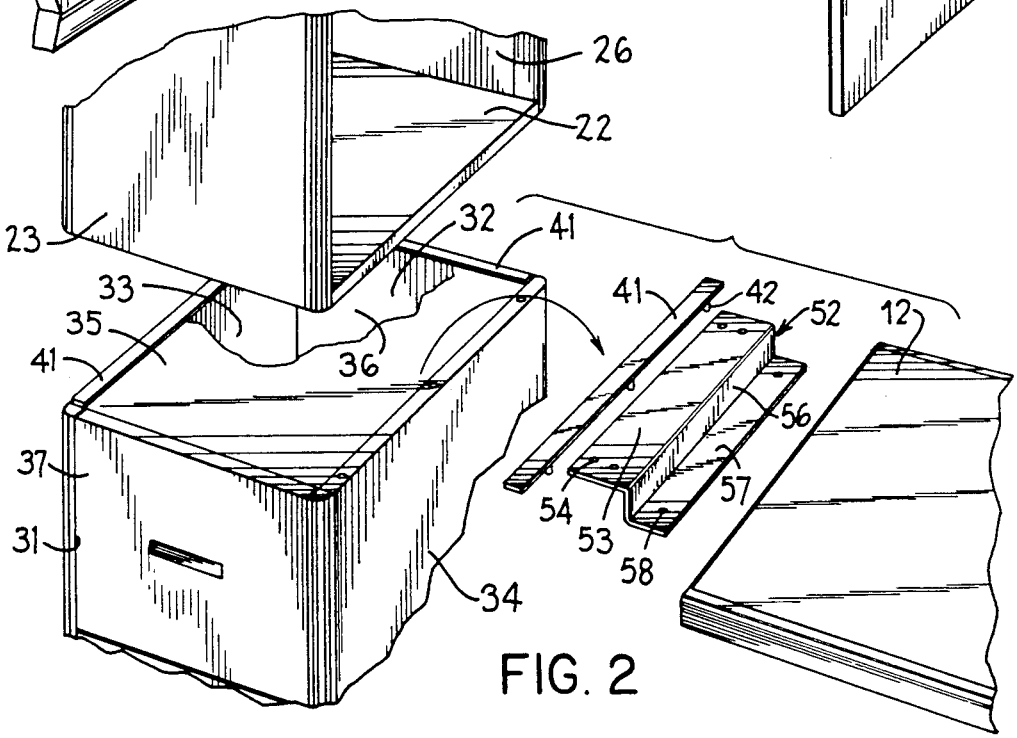
FIG. 2 is a fragmentary exploded view illustrating the cooperative relationships between the upper and lower cabinet and the adjacent end of the worktop.

Certain terminology will be used in the following description for convenience in reference only, and will not be limiting. For example, the words "upwardly", "downwardly", "rightwardly" and "leftwardly" will refer to directions in the drawings to which reference is made. The word "front" will be used to refer to the side of the cabinet in which the drawer fronts are provided, and "rear" will be used to refer to the opposite side of the cabinet. The words "inwardly" and "outwardly" will refer to directions toward and away from, respectively, the geometric center of the structure and designated parts thereof. Said terminology will include the words specifically mentioned, derivatives thereof, and words of similar import.

DETAILED DESCRIPTION

Referring to FIG. 1, there is illustrated a storage cabinet arrangement 11 intended for use in an office. This cabinet 11 is illustrated in conjunction with an adjacent worktop 12 and an upright space divider panel 13.

The cabinet arrangement 11 includes separate bottom and top cabinets 14 and 15, respectively which are adapted to vertically stack so as to provide the appearance of and function as a single cabinet. These cabinets 14 and 15 hence each have generally the same outer configuration and size, when viewed in plan, and in fact preferably have a width dimension "w" which is normally significantly less than the depth or length dimension "1". In fact, in a conventional office cabinet, the width w will typically be about 18 inches, and the depth or length 1 will typically be about 24 or 30 inches.

The bottom cabinet 14 is typically and preferably supported in slightly spaced relationship from the floor through an intermediate base or leg arrangement 16. The base or leg arrangement 16 may be attached to the underside of the cabinet 14, or may be separable therefrom so as to permit the base cabinet 14 to be supported thereon.

Considering first the structure of the top cabinet 15, it includes generally parallel platelike top and bottom walls 21 and 22, which in turn are rigidly joined together by a generally upright side wall structure. The cabinet and the side wall structure are generally rectangular in horizontal cross section and includes a pair of opposed and generally parallel sides 23 and 24 which extend in the widthwise direction of the cabinet and, in the illustrated embodiment, are defined by walls which effectively function as the respective front and rear walls. The cabinet also has a further pair of opposed and generally parallel sides 25 and 26 which extend perpendicularly between the walls 23 and 24. The side 25 is defined by a wall which generally closes off one side of the top cabinet. The other side 26, however, is defined primarily by a large access opening which provides sideward access into the interior compartment 27 defined within the top cabinet 15. This interior compartment 27 can be provided with suitable equipment, such as interior storage shelves 28, to permit storage of goods therein.

The top cabinet 15 may also be provided with one or more openable doors (not shown) associated with the opening 26 so as to permit closing off of the opening 26 when desired. Provision of such doors is conventional in storage cabinets, and the doors have been omitted from the drawings for convenience in illustration.

Considering now the lower cabinet 14, it includes a top wall 35 and a generally parallel bottom wall (not shown), which walls are rigidly joined by a generally upright side wall structure in a manner similar to the top cabinet. This side wall structure includes a pair of opposed sides 31 and 32 which extend in the widthwise direction, with the side 32 being defined by a vertical wall which functions as the back wall of the base cabinet. The front side 31 is, in the illustrated embodiment, defined primarily by a vertically enlarged access opening so as to provide access into the interior compartment 36 of the cabinet. The other or lengthwise extending sides of the base cabinet are defined by the generally parallel side walls 33 and 34 which are rigidly joined to the rear wall 32.

In the illustrated embodiment of the base cabinet 14, it is designed as a drawer unit in that it is provided with one or more drawers 37 which are slidably supported on the cabinet and project into the interior compartment 36, with the drawers 37 having face plates which substantially occupy and close off the access opening 31. The structure of the drawers 37 and their mode of slidable support on the side walls 33 and 34, is conventional. The drawers 37 are accessible from the front side of the cabinet and pull outwardly, whereby the drawers project inwardly of the cabinet along the direction of the length dimension 1, whereby the drawers provide for more efficient utilization of interior storage space when access is from the minimum-width side of the cabinet. However, it will be appreciated that the drawers can be removed and replaced by an openable swingable door if desired.

The base cabinet 14 is also provided with a reveal strip 41 removably supported along at least three of the upper edges thereof, which reveal strips in the illustrated embodiment are mounted on the upper ends of each of the side walls 32, 33 and 34. Each of the reveal strips 41 comprises a thin, narrow but elongate strip having a length which closely approximate the length of the upper edge of the respective side wall. The strip 41 is provided with a plurality of securing elements, specifically pins 42, fixed thereto and projecting downwardly from the underside thereof. These pins are snugly received into small upwardly opening bores 43 formed in the upper end of the respective side wall. The reveal strip is snugly secured to and positioned directly over the upper edge of the respective side wall, and defines thereon an upwardly facing flat surface 44 which in turn is adapted to directly supportingly bear against a lower edge of the respective side wall of the top cabinet 15.

Figure 4:
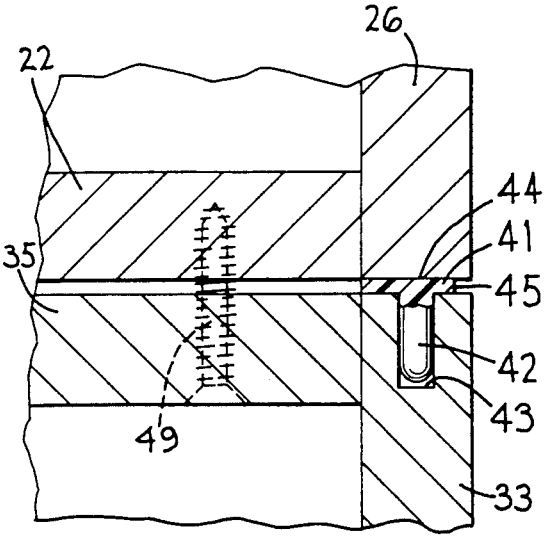
FIG. 4 is an enlarged fragmentary sectional view taken substantially along line 4—4 in FIG. 1.

When the top and bottom cabinets are vertically stacked together with the reveal strips 41 therebetween, as illustrated by FIG. 4, the front surface 45 of the reveal strip is spaced slightly inwardly from the adjacent planar exterior surfaces of the side walls so as to provide a shallow groove between the upper and lower side walls, which groove effectively encircles the cabinet. The shallow groove defined by the reveal strips facilitates vertical stacking of the upper and lower cabinets, and particularly provides a more desirable appearance since the groove appears to be for decorative purposes and disguises the fact that the cabinet arrangement is created from separate but stacked upper and lower units.

Further, with the improved cabinet arrangement 11 as described above, it will be appreciated that the upper cabinet 15 can be readily rotated 180° relative to the bottom cabinet 14 so that the access opening 26 may face either rightwardly or leftwardly, thereby greatly improving the flexibility of the arrangement.

After the upper and lower cabinets are suitably vertically stacked, then they are preferably fixedly secured together in a conventional manner. For example, a plurality of screws 49 (FIG. 4) can be utilized and positioned so as to extend upwardly through the top wall 35 of the lower cabinet into the bottom wall 22 of the upper cabinet. Such screws can be readily removed whenever reorientation of the upper cabinet is desired.

The cabinet arrangement 11 of this invention is also particularly suitable and desirable for use in conjunction with the horizontally enlarged worktop 12, as illustrated in FIG. 1.

This worktop 12 can be supported at one end thereof in a conventional manner, such as by a leg or support panel 51. The other end of this worktop 12, however, can be readily supported directly on the cabinet arrangement 11 without requiring any visible defacing of the cabinet.

More specifically, by removing a selected one of the reveal strips 41 and replacing it with a worktop support bracket 52, the worktop can be supported from the cabinet, while at the same time the bracket 52 functions in the manner of the removed reveal strip for providing a stable supporting engagement between the upper and lower cabinets.

The worktop supporting bracket 52 has a generally horizontally enlarged platelike top flange 53 which has a width substantially similar to that of the removed reveal strip 41. This top flange 53 is adapted to overlie the top of the lower cabinet and, in the illustrated embodiment, is provided with openings 54 for receiving screws 55 to permit a rigid securement of the bracket to the lower cabinet.

The top flange 53 of the bracket terminates in a downwardly projecting intermediate part 56 which is adapted to substantially directly overlie the exterior face of the cabinet side wall 34, and this intermediate flange 56 in turn joins to a bottom horizontal flange 57 which projects outwardly in the opposite direction from the top flange 53. Bottom flange 57 is adapted to project under and supportingly engage the worktop 12, and is preferably provided with openings 58 therethrough for accommodating fasteners or screws 59 to fixedly anchor the worktop thereto. The worktop bracket 52, which is generally Z-shaped in cross section, enables the worktop to be supported directly from one side of the cabinet, and yet is able to do so without effecting any physical defacing of the visible sides of the cabinet.

After the bracket and worktop have been secured, the top cabinet 15 can be repositioned in stack relationship above the bottom cabinet 14, whereupon the top flange 53 of the bracket now functions in the same manner as the removed reveal strip 41.

Figure 3:
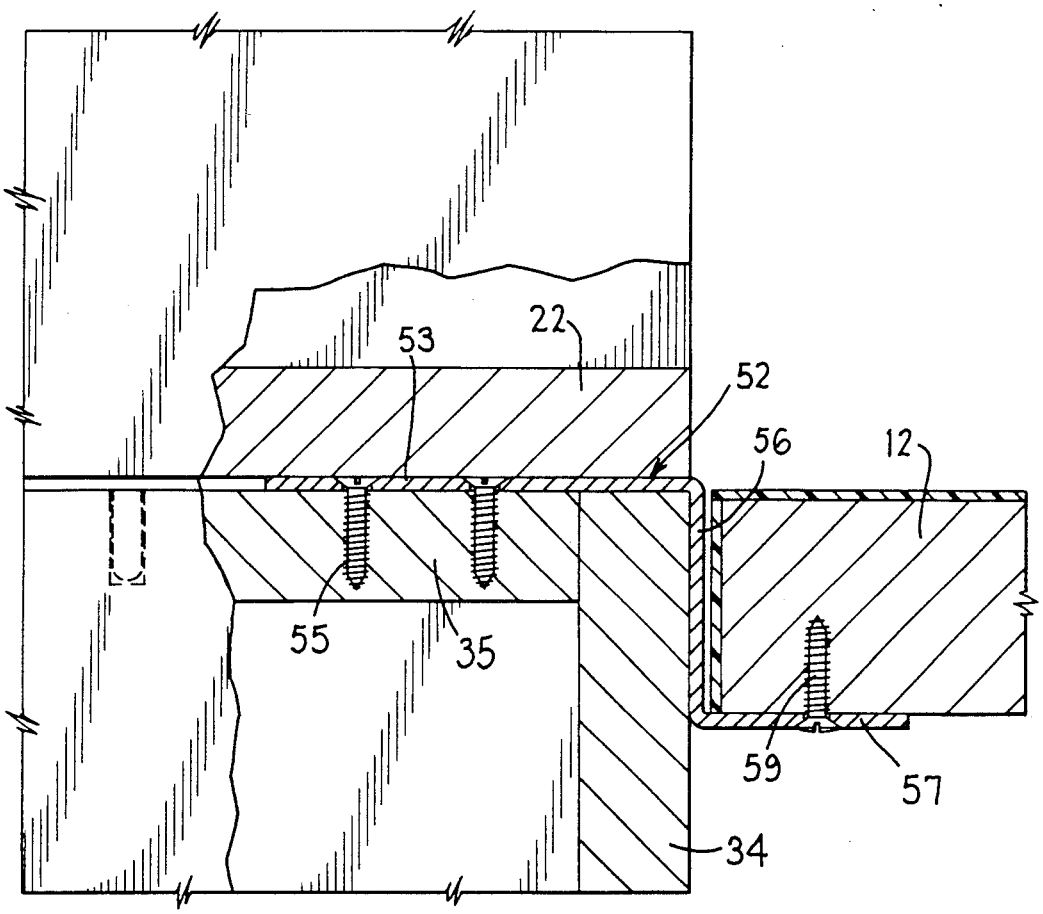
FIG. 3 is an enlarged fragmentary sectional view taken substantially along line 3—3 in FIG. 1.
Figure 5:
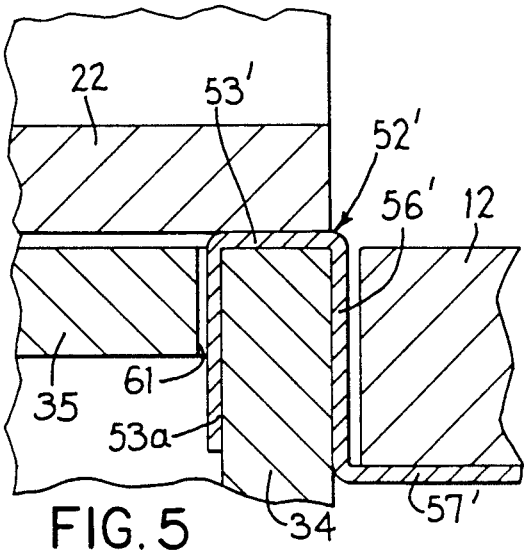
FIG. 5 is a view similar to FIG. 3 but illustrating a variation.

FIG. 5 illustrates a variation of the bracket arrangement illustrated by FIG. 3. More specifically, FIG. 5 illustrates a modified worktop support bracket 52' which again has a horizontal top flange 53' which overlies the top edge of the lower cabinet side wall 34. In this modified bracket 52', however, the extension of the flange 53' adjacent the free end thereof is bent downwardly to form a flange portion **53*a* which is spaced from but generally parallel with the intermediate flange 56'. The flanges 53', 53*a* and 56' define a generally downwardly opening channel-like structure which can be securely hooked over the upper edge of the cabinet side wall 34. To accommodate this hooked engagement, a part of the cabinet top wall 35, adjacent the inner side of the side wall 33, is removed to define a clearance slot 61 for accommodating the flange 53*a***.

With the modified worktop support bracket 52' of FIG. 5, the bracket can be attached to the cabinet solely by means of the channel structure being fitted over the top of the cabinet side wall, and hence no fastening of the bracket to the cabinet by screws or other fasteners is required. When the worktop is loaded, and when the upper cabinet 15 is positioned over the bracket, the bracket 52' is positively prevented from lifting upwardly out of engagement.

With the improved storage cabinet arrangement 11 and worktop 12 as illustrated by FIG. 1, the worktop can be supported directly on the cabinet without requiring a separate support leg, and at the same time the attachment of the worktop to the cabinet does not require defacing of the cabinet. Further, the cabinet provides optimum and desirable storage and accessibility to the user inasmuch as the lower part of the cabinet is provided with drawers which open forwardly, this being the side of the cabinet which is most easily accessible. At the same time, the upper cabinet 15 provides accessibility from the side thereof which opens directly onto the worktop, which not only provides greater access and increased convenience in usability with respect to the work space, but also provides greater usability of the cabinet storage space inasmuch as the access to the upper cabinet is through the lengthwise dimension thereof, rather than the narrower widthwise dimension.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A storage cabinet and worktop arrangement, comprising:

an upright storage cabinet arrangement being defined by separate and independent unitized upper and lower boxlike cabinets disposed in vertically stacked relationship one above the other;

said upper and lower cabinets having substantially identical horizontal rectangular cross sections, and each of said cabinets being defined by a pair of generally parallel first sides which extend in a widthwise direction and being additionally defined by a pair of parallel second sides which extend in a depthwise direction of the cabinet and extend generally perpendicularly between the first sides;

one of the sides of each of the upper and lower cabinets being defined by a vertically enlarged access opening for providing access to a respective storage compartment defined within the interior of the respective boxlike cabinet, the remaining sides of each of said cabinets being defined by generally vertical upright walls;

removable reveal strip means positioned between upper ends of the side walls of the lower cabinet and lower ends of the side walls of the upper cabinet for supporting the upper cabinet on but slightly vertically above the lower cabinet, said removably reveal strip means including a plurality of separate reveal strips, each said reveal strip comprising a vertically thin but horizontally elongate platelike strip adapted to be removably positioned in direct supportive engagement with an upper edge of each side wall of said lower cabinet;

a horizontally enlarged and substantially planar worktop positioned adjacent said cabinet arrangement and disposed at an elevation which closely approximates the height of the lower cabinet, said worktop having one end thereof position directly adjacent one said side wall of said lower cabinet substantially adjacent the upper edge thereof; and support bracket means for vertically supporting said one end of said worktop from said cabinet arrangement without physically defacing exposed vertical sides of said cabinet arrangement, said support bracket means having a first horizontal support flange which project horizontally over the upper edge of said one side wall and replaces the reveal strip which is normally positioned on the upper edge of said one side wall, said support flange having a thickness which substantially corresponds to the thickness of the reveal strip, said support flange also having means associated therewith for securing the support bracket means to the lower cabinet in load bearing relationship therewith, said bracket means also having a second substantially horizontal support flange which is fixedly coupled to said worktop in the vicinity of said one end.

2. A combination according to claim 1, wherein said second support flange is spaced vertically downwardly from said first support flange and is joined thereto by an intermediate vertical flange which overlies the exterior surface of said one side wall, whereby said first and second support flanges and said intermediate flange define a generally Z-shaped configuration.

3. A combination according to claim 2, wherein said first support flange projects horizontally inwardly so as to overlie a top wall of said lower cabinet and is fixedly secured thereto by fasteners.

4. A combination according to claim 1, wherein said one side wall of said lower cabinet extends in the depthwise direction, and said access opening in said upper cabinet being formed in one of said depthwise sides.

5. A combination according to claim 4, wherein the access opening in said top cabinet is formed in the side thereof which is disposed directly over said one end of said worktop, and wherein the access opening is said lower cabinet is formed in one of the widthwise sides.

6. A combination according to claim 1, wherein each reveal strip has means associated therewith and cooperating with the respective side wall of the lower cabinet for removably retaining the reveal strip on the upper end of the respective side wall.

7. A combination according to claim 1, wherein each of the side walls of the lower cabinet has a plurality of small bores opening downwardly from the upper end thereof, and wherein each reveal strip has a plurality of small pins fixed thereto and projecting vertically downwardly therefrom for engagement within the bores of the respective side wall.

8. An office-type storage cabinet arrangement, comprising:

a bottom boxlike cabinet having a substantially rectangular horizontal cross section defined by a length dimension which is substantially greater than a width dimension;

said bottom cabinet having a pair of generally parallel first sides which extend in the widthwise direction and which are joined by a pair of generally parallel second sides which extend perpendicularly between said first sides, said pair of second sides and one of said first sides being defined by generally upright and solid side walls, the other of said first sides defining a vertically enlarged access opening therethrough for providing access to an interior storage compartment defined within said bottom cabinet;

a top boxlike cabinet supported vertically but removably on top of said bottom cabinet, said top cabinet having a horizontal cross section of rectangular shape which is substantially identical to the horizontal cross sectional shape of the bottom cabinet, said top cabinet having horizontal width and length dimensions substantially corresponding to the respective width and length dimensions of the bottom cabinet;

said top cabinet having generally parallel top and bottom walls disposed in vertically spaced relationship;

said top cabinet being defined by a pair of parallel first sides which extend in the widthwise direction and which are joined by a pair of parallel second sides which extend in the lengthwise direction and perpendicularly join the first sides, the pair of first sides and one of the second sides being defined by vertical upright walls which are substantially solid, and the other said second side defining a vertically enlarged access opening for providing access into an interior storage compartment defined within said top cabinet; and removable reveal strip means interposed between the upper end of said bottom cabinet and the lower end of said top cabinet for vertically supporting said top cabinet on said bottom cabinet while maintaining the vertical side walls of the top and bottom cabinets in slightly vertically spaced relation, said reveal strip means including a plurality of separate reveal strips which are vertically thin and horizontally elongated, one of said reveal strips being removably positioned directly over and extending generally along the upper edge of each of the side walls of said bottom cabinet, each reveal strip having an outer vertical edge face which, when the reveal strip is seated and retained on the upper edge of the respective side wall of the bottom cabinet, is spaced horizontally inwardly a small distance from the exterior surface of the respective side wall so that the reveal strip defines a shallow horizontal groove at the interface between the respectively vertically adjacent side walls of the top and bottom cabinets.

9. A cabinet arrangement according to claim 8, wherein said reveal strip includes means thereon and cooperating with the respective side wall of the bottom cabinet for normally maintaining the reveal strip engaged with the bottom cabinet.

10. A cabinet arrangement according to claim 8, wherein each reveal strip has a plurality of small retaining pins fixed thereto and projecting vertically downwardly therefrom, and wherein each side wall of the lower cabinet has a plurality of small openings which project downwardly from upper edges thereof for receiving therein the retaining pins on the respective reveal strip.

* * * * *